US009890557B2

(12) United States Patent
Vandervelden

(10) Patent No.: US 9,890,557 B2
(45) Date of Patent: Feb. 13, 2018

(54) LEAF OF A SLIDING WINDOW OR SLIDING DOOR AND SLIDING WINDOW OR SLIDING DOOR PROVIDED WITH SUCH A LEAF

(71) Applicant: Reynaers Aluminium NV, Duffel (BE)

(72) Inventor: Stefan Vandervelden, Antwerp (BE)

(73) Assignee: Reynaers Aluminium NV, Duffel (BE)

( * ) Notice: Subject to any disclaimer, the term of this patent is extended or adjusted under 35 U.S.C. 154(b) by 0 days.

(21) Appl. No.: 14/910,054

(22) PCT Filed: Aug. 21, 2014

(86) PCT No.: PCT/BE2014/000040

§ 371 (c)(1),
(2) Date: Feb. 4, 2016

(87) PCT Pub. No.: WO2015/027301

PCT Pub. Date: Mar. 5, 2015

(65) Prior Publication Data

US 2016/0177595 A1 Jun. 23, 2016

(30) Foreign Application Priority Data

Aug. 30, 2013 (BE) ..... 2013/0566

(51) Int. Cl.
*E05B 15/02* (2006.01)
*E05B 65/08* (2006.01)
(Continued)

(52) U.S. Cl.
CPC ..... *E05B 15/02* (2013.01); *E05B 15/025* (2013.01); *E05B 65/08* (2013.01); *E05B 65/0888* (2013.01); *E05C 1/002* (2013.01); *E06B 3/4609* (2013.01); *E06B 3/4636* (2013.01); *E06B 2003/7046* (2013.01); *Y10S 292/46* (2013.01);
(Continued)

(58) Field of Classification Search
USPC ..... 49/449
See application file for complete search history.

(56) References Cited

U.S. PATENT DOCUMENTS 3,103,713 A * 9/1963 Ahlgren ..... E05B 65/0876 292/175
3,418,016 A * 12/1968 Levine ..... E05B 65/0841 292/129
(Continued)

FOREIGN PATENT DOCUMENTS

GB 2308404 A 6/1997
JP 2001241272 A 9/2001

*Primary Examiner* — Katherine W Mitchell
*Assistant Examiner* — Marcus Menezes
(74) *Attorney, Agent, or Firm* — James Creighton Wray; Meera P. Narasimhan

(57) ABSTRACT

Leaf (4) of a sliding window (1) or sliding door, whereby this leaf (4) has a horizontal profile (13) and an upright side profile (12) perpendicular to the horizontal profile (13), whereby the horizontal profile (13) is provided with a lock plate (10) for a lock (9), whereby the leaf (4) is equipped with an adjustment mechanism to be able to adjust the position of the lock plate (10) in the direction (P) in which the horizontal profile (13) extends and to be able to secure the lock plate (10) to the leaf (4), whereby the adjustment mechanism can be operated from the side where the side profile (12) is located.

17 Claims, 8 Drawing Sheets

(51) Int. Cl.
*E05C 1/00* (2006.01)
*E06B 3/46* (2006.01)
*E06B 3/70* (2006.01)

(52) U.S. Cl.
CPC ..... *Y10S 292/60* (2013.01); *Y10T 292/68* (2015.04); *Y10T 292/696* (2015.04); *Y10T 292/705* (2015.04)

(56) References Cited

U.S. PATENT DOCUMENTS

| | | | | | |
|---|---|---|---|---|---|
| 3,984,136 | A * | 10/1976 | Bills | E05C 1/06 | 292/182 |
| 4,189,870 | A * | 2/1980 | Helmick | E05D 15/0669 | 16/105 |
| 4,304,429 | A * | 12/1981 | Gist | E05B 65/0894 | 292/257 |
| 5,015,022 | A * | 5/1991 | McGuire | E05B 65/0888 | 292/278 |
| 6,321,413 | B1 * | 11/2001 | Zingg | E05D 15/0634 | 16/105 |
| 8,752,871 | B2 * | 6/2014 | Rechberg | E05B 15/0205 | 292/340 |
| 9,328,543 | B2 * | 5/2016 | Burd | E05C 19/009 | |
| 2004/0046398 | A1 * | 3/2004 | Haab | E05B 65/0085 | 292/96 |
| 2013/0020919 | A1 | 1/2013 | Rechberg | | |
| 2013/0180296 | A1 * | 7/2013 | McEachern | E05B 65/08 | 70/97 |

* cited by examiner

LEAF OF A SLIDING WINDOW OR SLIDING DOOR AND SLIDING WINDOW OR SLIDING DOOR PROVIDED WITH SUCH A LEAF

This application claims the benefit of Belgian Application No. 2013/0566 filed Aug. 30, 2013 and PCT/BE2014/000040 filed Aug. 21, 2014, International Publication No. WO 2015/027301, which are hereby incorporated by reference in their entirety as if fully set forth herein.

The present invention relates to a leaf of a sliding window or sliding door.

More specifically the invention concerns sliding windows or sliding doors with a frame fastened immovably in a wall, in which one or more leaves that can slide are fastened, and in which there can also be fixed leaves that cannot slide.

These are large windows for example that can continue down to floor level and through which access can be gained to a terrace, for example, from a living room. They can be considered as sliding windows, but also as sliding doors. In this description only the word sliding window will be used, which also means a similar construction with a door character, thus running down to the floor and wide and high enough to act as a passageway.

For aesthetic reasons there is a great demand for sliding windows with a minimal aspect. This means that the outermost frame of the sliding window is concealed as much as possible in a wall and the floor if applicable, so that the frame profiles have the minimum possible visibility and that the leaf profiles are kept as slim as possible.

Hereby the lock and any motor to drive the sliding leaf is preferably placed in the frame, so that they do not constitute a visual disturbance.

However it is difficult to firmly affix a lock plate, i.e. a component of an essentially plate form with a hole or holes to receive a pin or pins of the lock, on the leaf, because when installing a leaf in an outer frame there is no further space at the top of the leaf to perform the operations to affix the necessary hardware components, such as the lock plate or a coupling to a drive motor.

BACKGROUND OF THE INVENTION

Belgian patent application No. 2013/0015 provides a solution to this, whereby a lock plate is slidably placed in a groove in the top profile from the side, where the groove is open and secured by means of a connecting piece that is slid in a similar groove in the side profile of the leaf.

However, the manufacturing tolerances of the leaf and the outer frame mean that the positions of the lock and the lock plate sometimes poorly correspond, so that either a pin or pins of the lock do not enter into the lock plate, such that the lock does not work, or there is a greater than desired play between the pins and the lock plate.

SUMMARY OF THE INVENTION

The purpose of the present invention is to provide a solution to a least one of the aforementioned and other disadvantages, by providing a leaf of a sliding window or sliding door, and this leaf has a horizontal profile and an upright side profile perpendicular to the horizontal profile, whereby the horizontal profile is provided with a lock plate for a lock, whereby the leaf is provided with an adjustment mechanism to be able to adjust the position of the lock plate in the direction in which the horizontal profile extends, and to be able to fasten the lock plate to the leaf, whereby the adjustment mechanism can be operated from the side where the side profile is located.

Hereby all indications of the profiles are considered as relating to the leaf in the mounted situation.

This thus means that the horizontal profile is a top or bottom profile of the leaf in the mounted situation, and the side profile is a vertical profile when the leaf is mounted.

Also with a leaf in the non-mounted situation, it is clear to a man skilled in the art what the orientation of the leaf will be in the mounted situation, i.e. which profile of the leaf will be on the top, bottom or side after mounting, because all these sides are provided with different seals and fittings. For example, the bottom profile is usually provided with wheels that enable movement. This also follows naturally from complementary characteristics of a surrounding frame in which the leaf has to be fitted.

This has the advantage that the position of the lock plate can be easily adjusted, without the leaf having to be taken out of the outer frame, because the side, i.e. the edge where the side profile is located is accessible for a fitter.

As a result the good operation of the lock of such a sliding window is guaranteed.

The play between the lock and the lock plate can also be kept to a minimum.

This can also be done while the leaf is in the closed position. It is thus not necessary to repeatedly adjust the position of the lock plate with the leaf in the open position and then to confirm the correctness of the position by bringing the leaf to a closed position.

The horizontal profile is normally a top profile, but can also be a bottom profile.

In a preferred embodiment the adjustment mechanism comprises the following components:

- a hole in the lock plate or a fixed component attached thereto, whereby this hole extends horizontally and is provided with an internal screw thread;
- at least one adjusting rod that is at least partly provided with an external screw thread and which is affixed in the hole, whereby the adjusting rod has a head that is arranged to engage with a tool to rotate the adjusting rod and which is oriented towards the side where the side profile is located.

By screwing the adjusting rod in and out of the hole the distance between the head and the lock plate can be adjusted, such that a reliable adjustment possibility is obtained in an easy way.

A big advantage is that the adjustment can be done blind, because often there is no or only limited access for a fitter. This means that the fitter can place the tool on the head by feel and thereby turn the adjusting rod.

In a further preferred embodiment the horizontal profile is provided with a first groove with undercut flanks that extends in the longitudinal direction of the horizontal profile, whereby a first carriage is held in the first groove, whereby the lock plate forms part of the first carriage or is fastened thereto, and whereby preferably the said hole is made in the first carriage.

The advantage of this is that the lock plate is fixed in the top profile, except for a movement in the longitudinal direction of the groove, so that the adjustment mechanism only has to be provided to secure the carriage in one direction.

In a further preferred embodiment the adjustment mechanism also comprises a gripping element, which, at least in the horizontal direction, has a fixed position with respect to the horizontal profile whereby the adjusting rod and the gripping element are arranged such that the adjusting rod can be secured to the gripping element or that the gripping element forms an end stop for the adjusting rod.

For clarity it is hereby noted that a gripping element means a component with a fixed position with respect to the leaf as a whole, to which the rest of the adjustment mechanism is fastened, so that the gripping element is the component with respect to which the lock plate is adjustable.

In a further preferred embodiment the side profile is provided with a second groove with undercut flanks that extends longitudinally in the side profile, whereby a second carriage is held in the second groove and the gripping element is formed by the second carriage.

This gives a good and sturdy construction method for the gripping element, so that the lock plate can be firmly fastened, whereby the first and second groove and the first and second carriage can be of the same shape so that standardisation is possible.

In a further preferred embodiment the gripping element is provided with a horizontal passage and the adjusting rod is provided with a thickening and a screw thread between the head and the thickening, whereby the passage is of such a size that the part between the head and the widening fits through the passage, but not the widening.

In an alternative preferred embodiment, the adjustment mechanism comprises two of the above-mentioned holes and two of the above-mentioned adjusting rods, whereby the gripping element is provided with two horizontal passages, whereby a first combination of a passage and an adjusting rod is such that the adjusting rod is not inserted through the passage and the head of the adjusting rod does not fit through the passage, but a tool to rotate the adjusting rod does fit through the passage and whereby a second combination of a passage and an adjusting rod is such that the head of the adjusting rod does not fit through the passage and the adjusting rod is inserted through the passage.

With the intention of better showing the characteristics of the invention, a preferred embodiment of a leaf and a method according to the invention is described hereinafter by way of an example, without any limiting nature, with reference to the accompanying drawings, wherein:

DETAILED DESCRIPTION OF THE INVENTION

Figure 1:
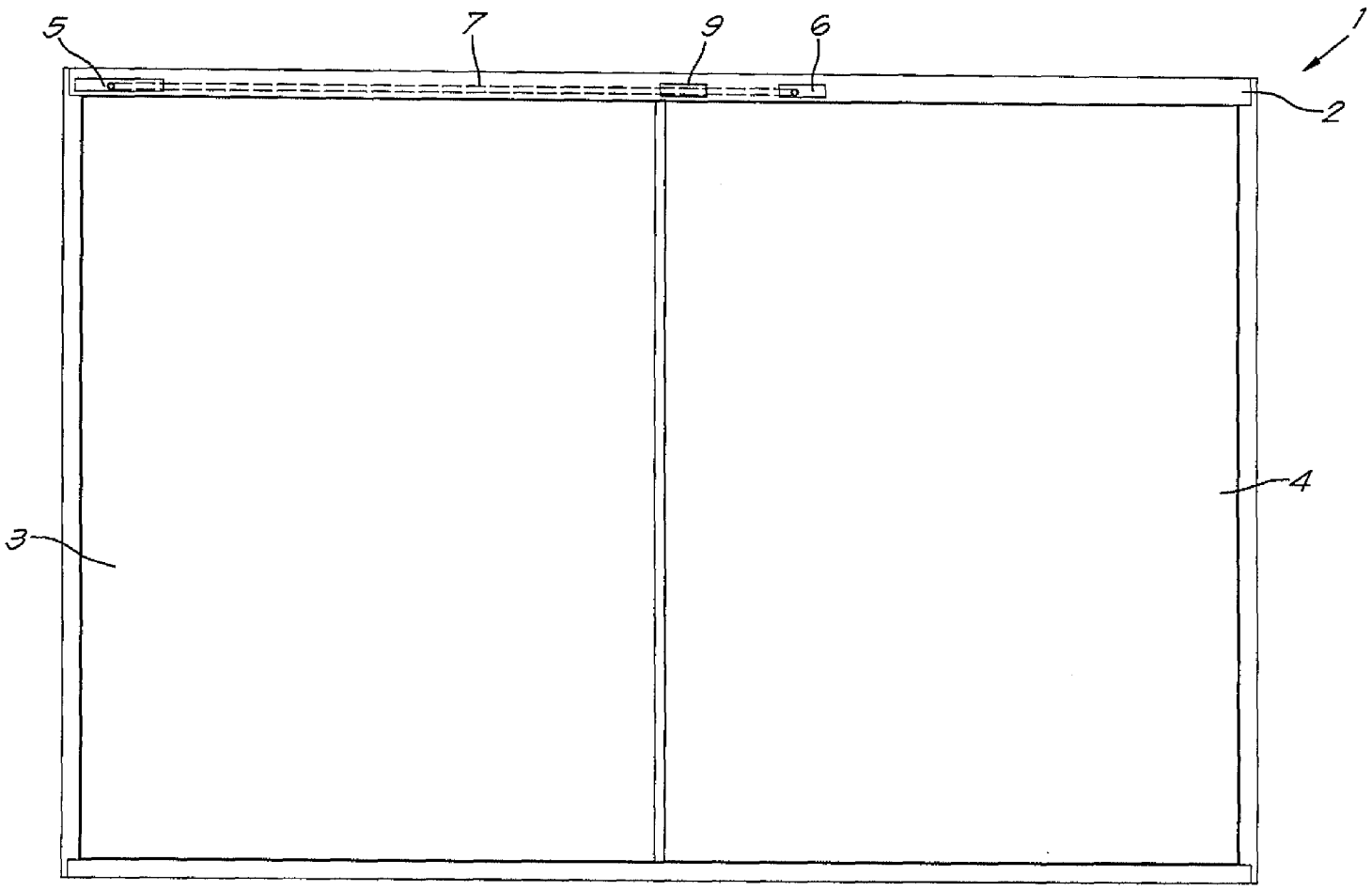
FIG. 1 shows an outside view of a sliding window provided with a leaf according to the invention.
Figure 2:
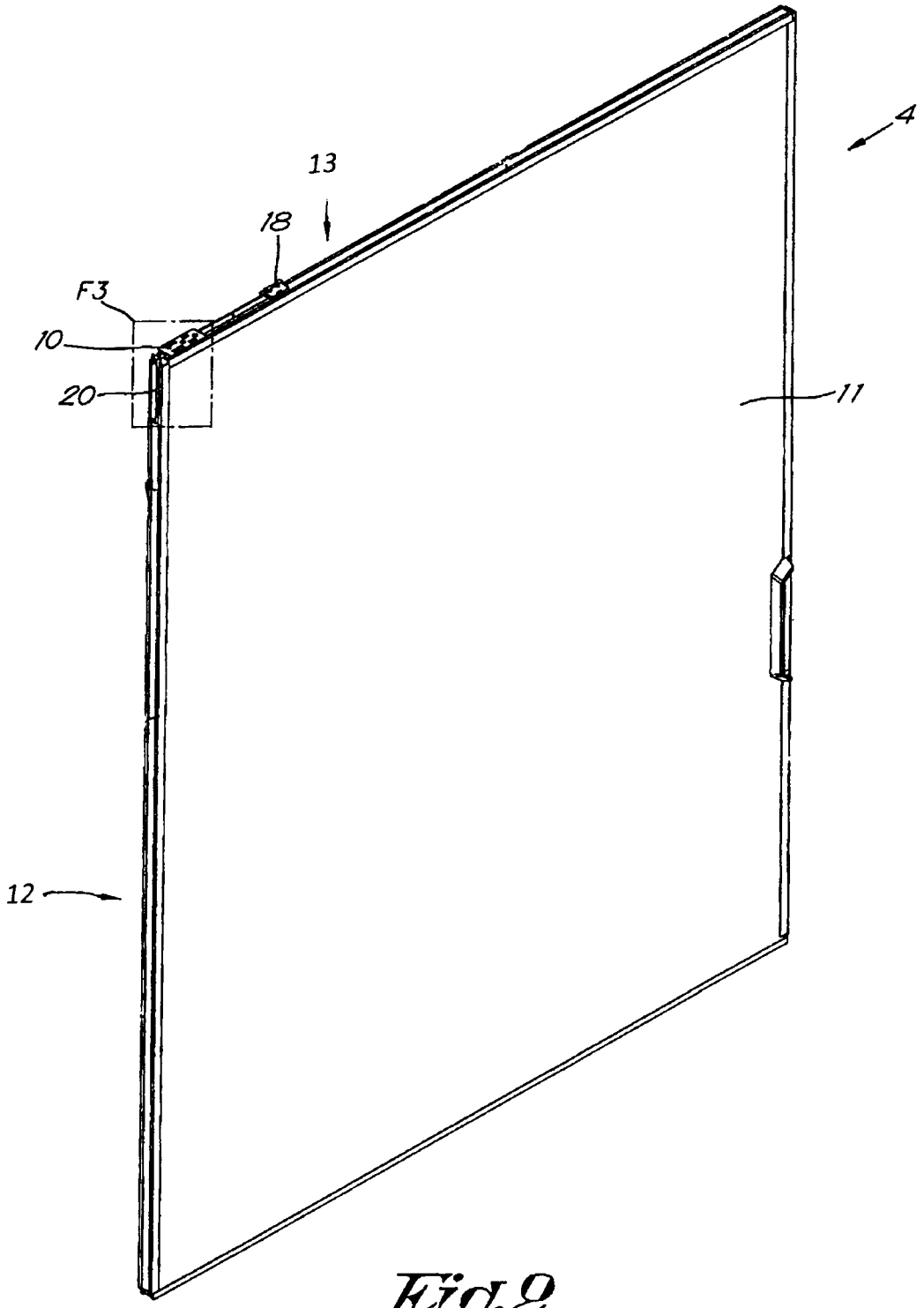
FIG. 2 shows a perspective view of a leaf according to the invention.

The sliding window 1 shown in FIG. 1 comprises a frame 2, a fixed leaf 3 and a slidable leaf 4.

In order to be able to move the slidable leaf 4, in this example but not necessarily, a motor 5 is provided that is connected to the slidable leaf 4 via a drive belt 7 running over a reversing roller 6 and a first carriage 8, not shown in FIG. 1.

A lock 9 is also provided, which together with a lock plate 10 provided on the first carriage 8, can lock the slidable leaf 4 in a closed position.

The motor 5, reversing roller 6, lock 9 and drive belt 7 are schematically indicated in FIG. 1, although they are affixed in the frame 2 and are thereby enclosed and thus not visible from the outside.

As can be seen in FIGS. 2 to 5 the slidable leaf 4 essentially consists of a glass panel 11 that is provided on its sides and top with a side profile 12 or a top profile 13.

In this example but not necessarily, these side and top profiles 12, 13 have an identical cross-section. They are provided with a groove 14 with undercut flanks 15 oriented towards the outside, thus away from the glass panel 11.

The aforementioned first carriage 8 is mounted in the groove 14 of the top profile 13. A coupling 18 is mounted on this first carriage 8 for the said drive belt 7, as well as a lock plate 10 for the lock 9. The drive belt 7 is normally connected to the coupling 18 in the situation shown, but for the purpose of a better presentation of the invention it is not shown in FIGS. 2 to 9.

Figure 5:
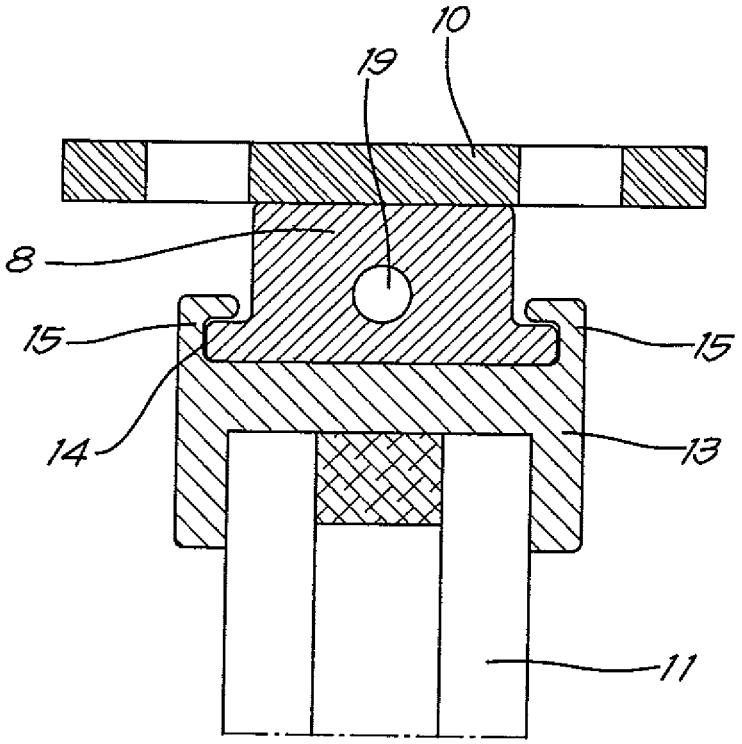
FIG. 5 shows a cross-section of the leaf of FIG. 3 according to line V-V.
Figure 6:
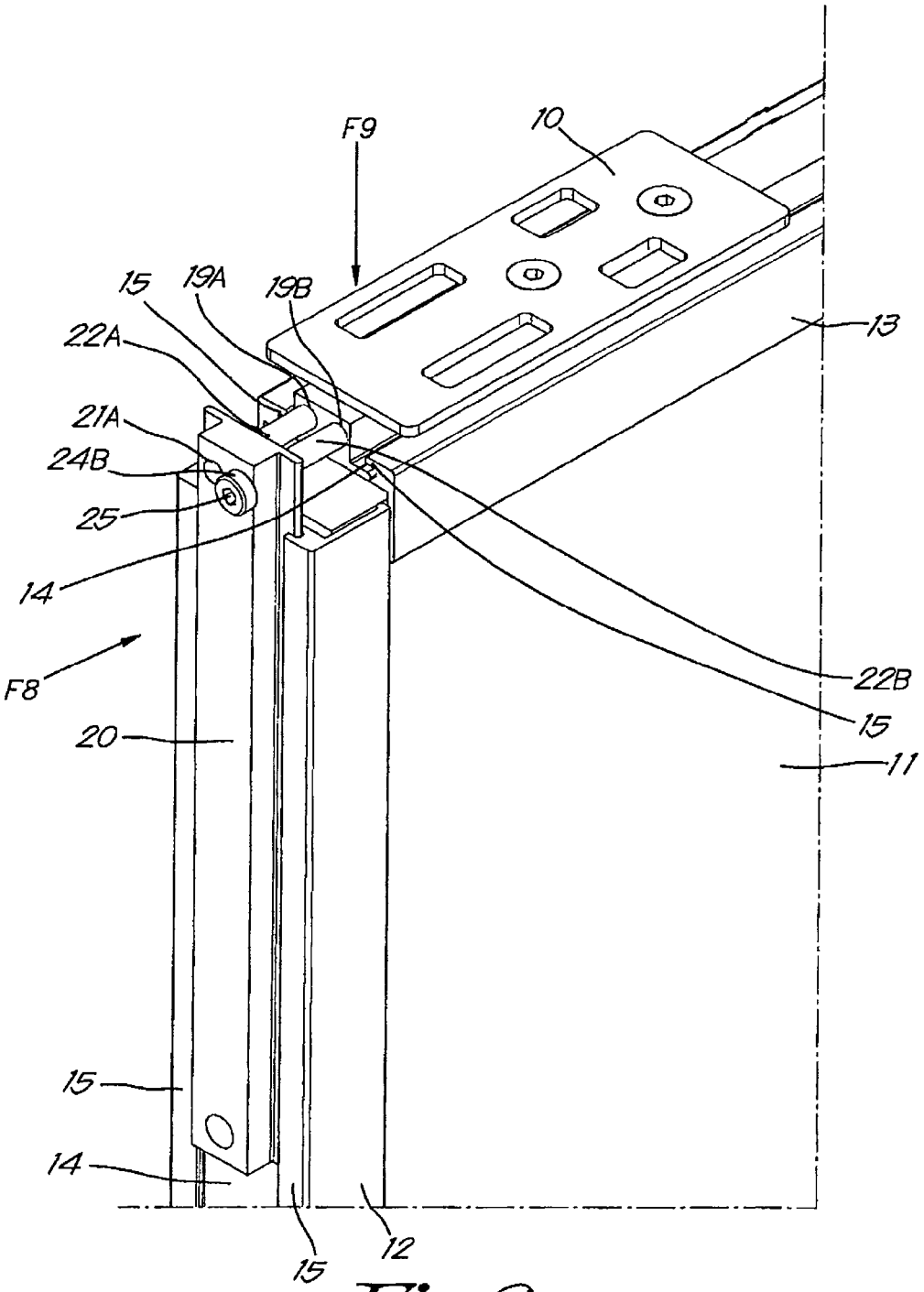
FIG. 6 shows an alternative leaf according to the invention in a presentation as in FIG. 3.
Figure 7:
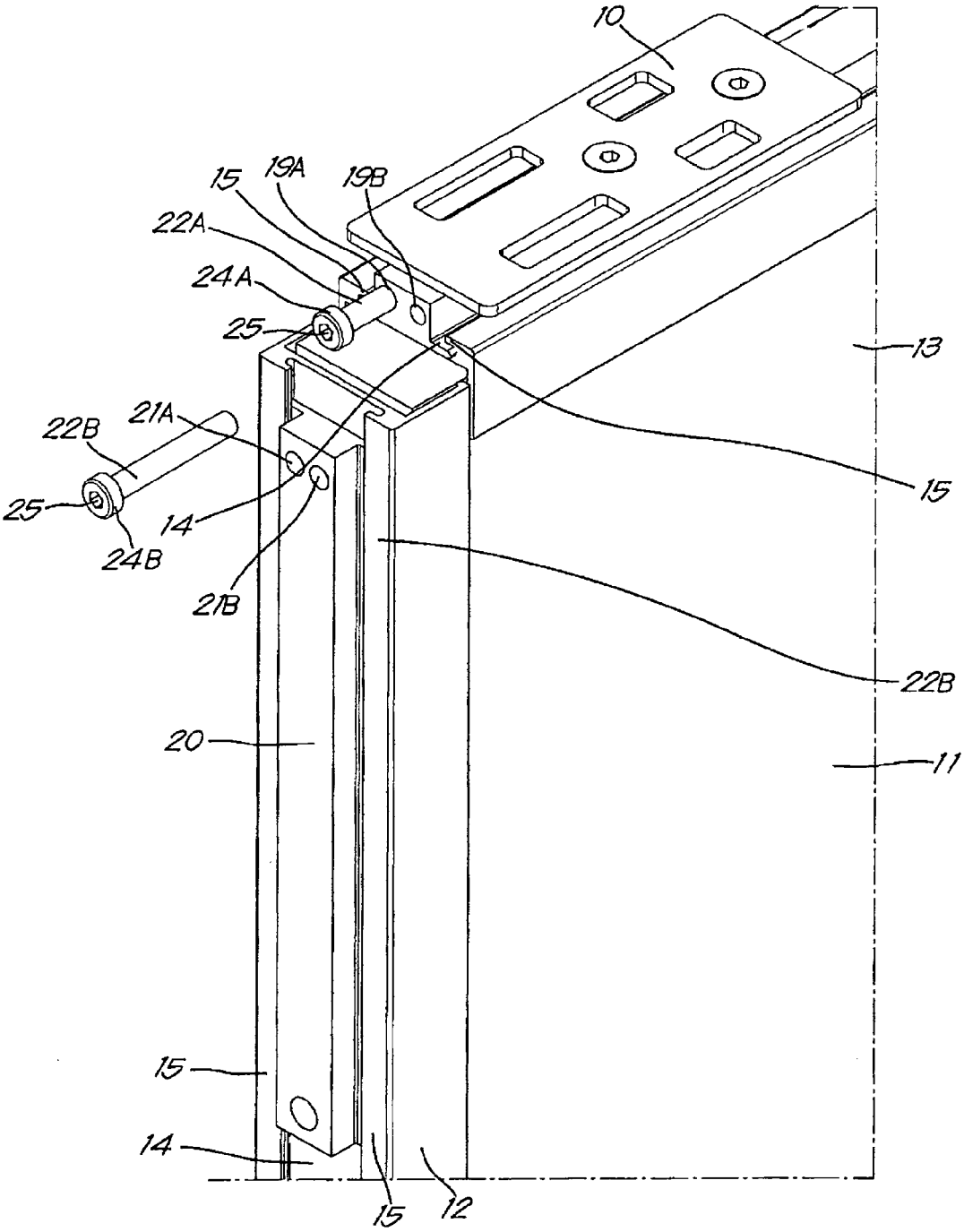
FIG. 7 is a similar presentation as FIG. 6, with the leaf in a partially dismantled situation.
Figure 8:
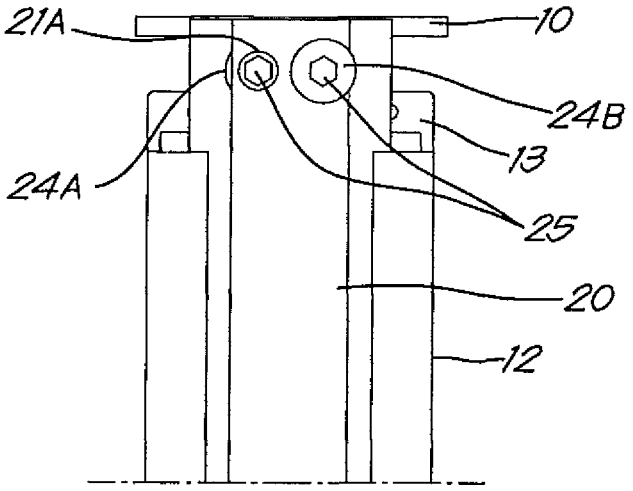
FIG. 8 shows a side view of a part of the leaf of FIG. 6, as indicated by F8.
Figure 9:
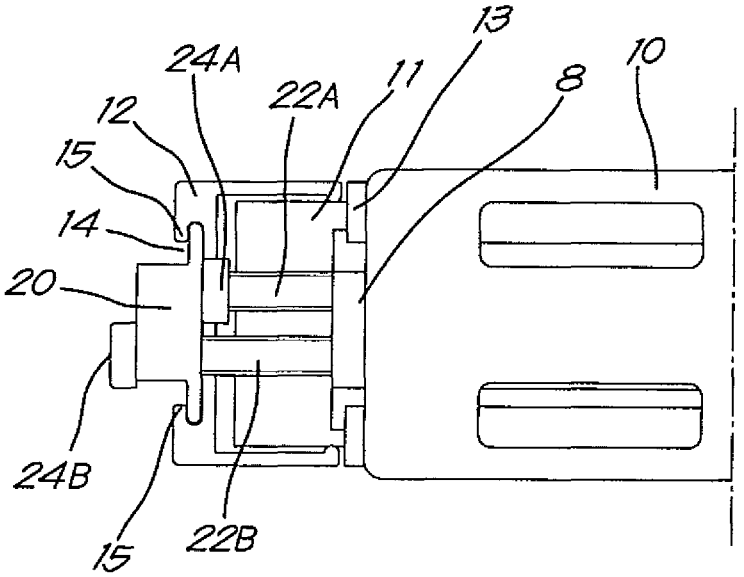
FIG. 9 shows a top view of a part of the leaf of FIG. 6, as indicated by F9.

As is especially clear from FIG. 5, the shape of the bottom part of the first carriage 8 is largely complementary to the shape of the groove 14 of the top profile 13.

The first carriage is provided with a horizontal hole 19 with an internal screw thread.

A second carriage 20 is affixed in the groove 14 of the side profile 12, which is located close to the top of this side profile 12.

A horizontal passage 21 is made in this second carriage 20.

The first carriage 8 and the second carriage 20 are coupled together by means of an adjusting rod 22 and a first nut 23.

The adjusting rod 22 is provided over its entire length with an external screw thread that is complementary to the screw thread in the hole 19 of the first carriage 8. The adjusting rod 22 has a head 24 that is provided with a hexagonal recess 25 for a socket screw key.

At some distance from the head 24 there is a thickening, in this case in the form of a second nut 26 that is affixed to the adjusting rod 22 by means of the screw thread, and is fastened thereto, for example by welding or gluing.

The end of the adjusting rod 22 turned away from the head 24 is screwed in the hole 19 of the first carriage 8. The other end, i.e. the end with the head 24, is inserted through the passage 21. By means of a first nut 23 the adjusting rod 22 is fastened to the second carriage 20, whereby the second carriage 20 is fastened between the first nut 23 and the second nut 26, so that the adjusting rod 22, and thus also the first carriage 8, is firmly secured.

The second carriage 20, and in particular the top end thereof, thereby forms, via the adjusting rod 22, a gripping element 20*a* that is unmovable in the horizontal direction for the first carriage 8 and the components fastened thereon, that restrains this first carriage 8 thereof from moving horizontally.

Figure 3:
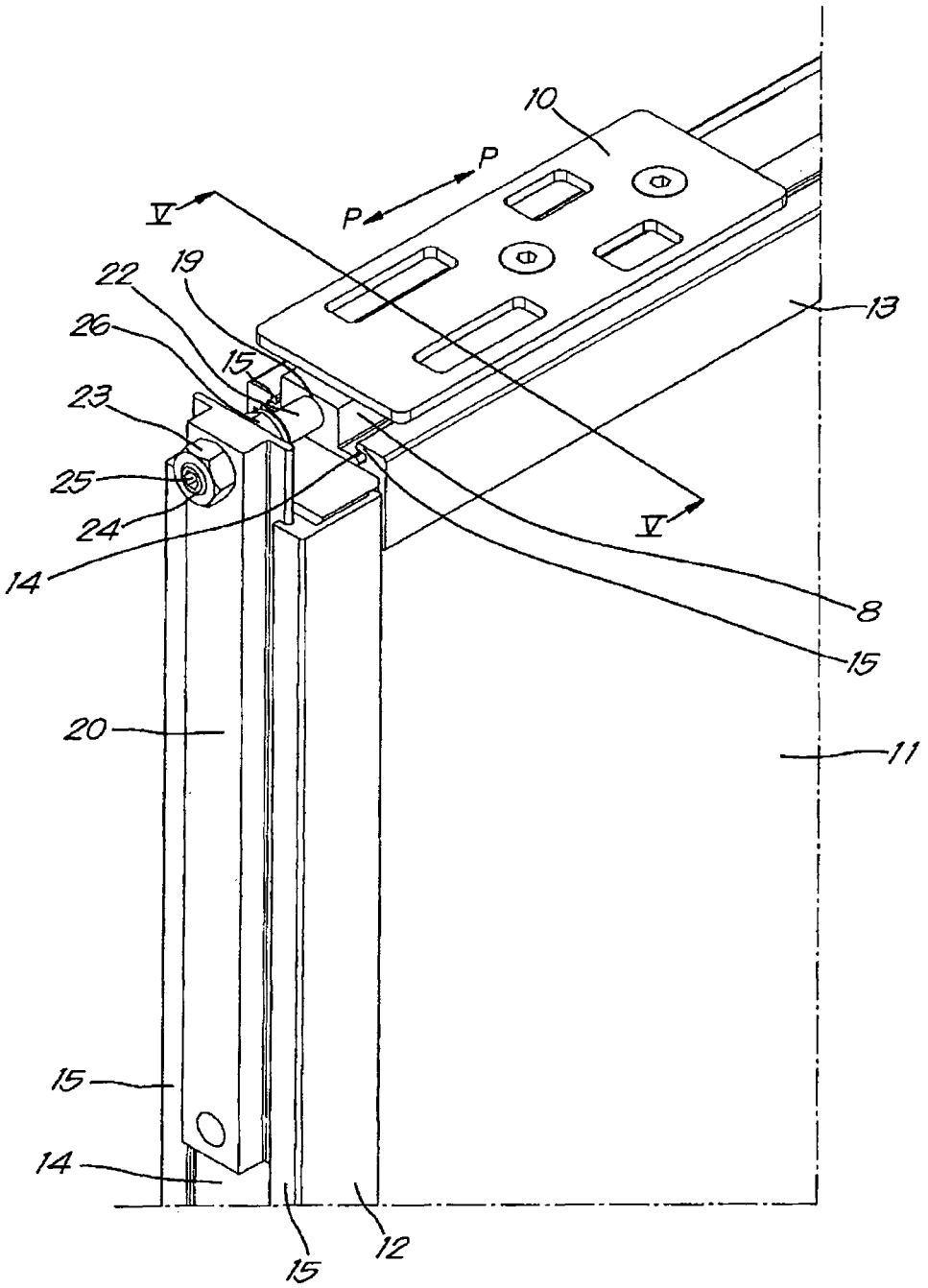
FIG. 3 shows an enlargement of the part of the leaf of FIG. 2 indicated by F3.
Figure 4:
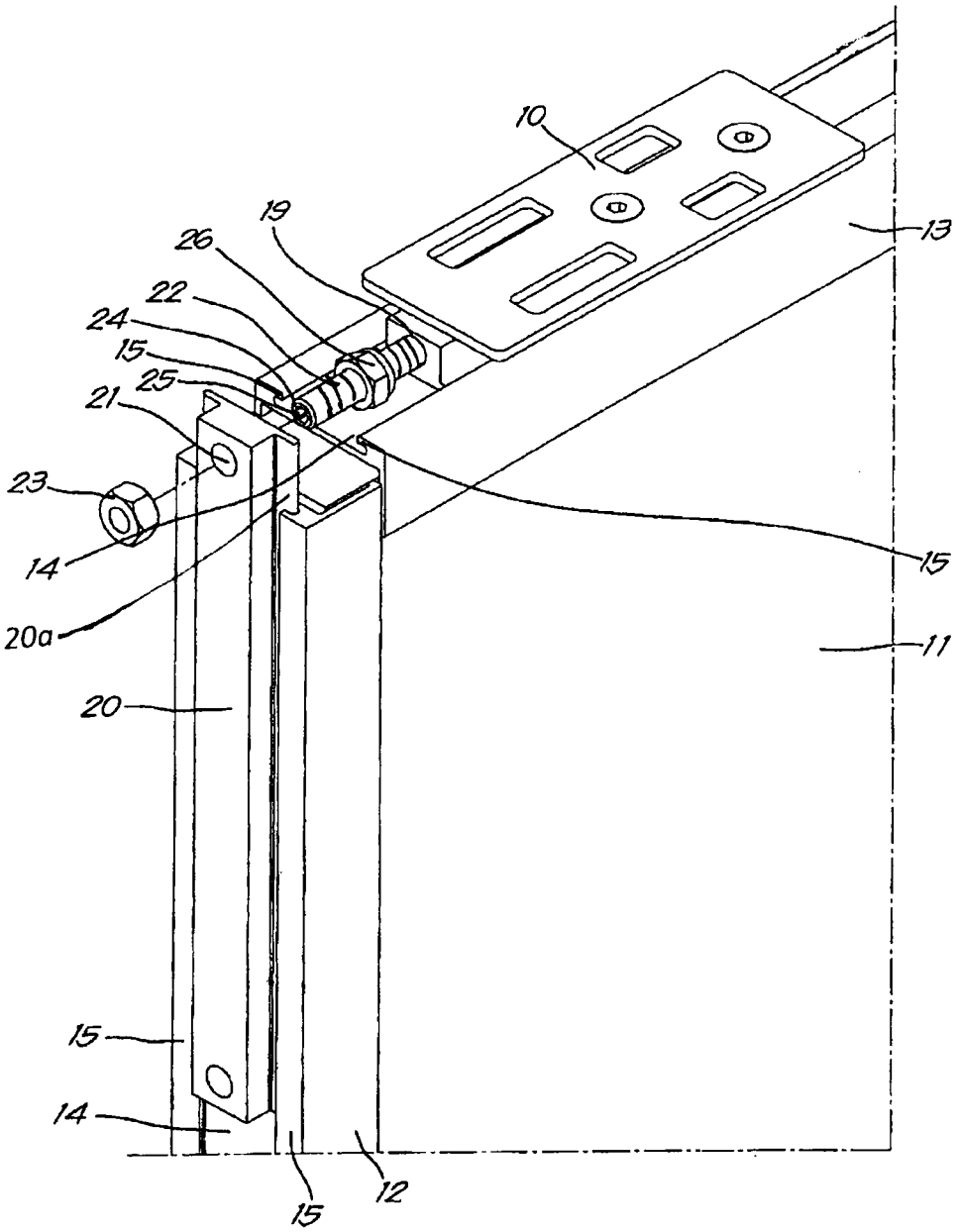
FIG. 4 is a similar presentation as FIG. 3, with the leaf in a partly dismantled situation.

In order to adjust the position of the lock plate 10 in the longitudinal direction of the top profile 13, indicated by arrow P in FIG. 3, the first nut 23 is loosened somewhat, after which the adjusting rod 22 can be rotated from the side of the side profile 12 by means of a socket screw key that is inserted in the head 24 of the adjusting rod 22.

This results in the adjusting rod 22 being turned in or out of the hole 19 in the first carriage 8, so that the distance between the second carriage 20 and the first carriage 8 becomes smaller or larger. As soon as the first carriage 8 is in a position in which the lock plate 10 correctly engages with the lock 9, the first nut 23 is tightened again.

The first carriage 8, the adjusting rod 22 and the second carriage 20 together form an adjustment mechanism in order to adjust the position of the lock plate 10 and to be able to fasten the lock plate 10 to the leaf 4.

This action can be done while the leaf 4 is mounted in the frame 2, because for the adjustment only access to the first nut 23 and the head 24 of the adjusting rod 22 is required, whereby this access is possible from the side of the side profile 12.

The alternative embodiment of a slidable leaf 4 shown in FIGS. 6 to 9 differs from the embodiment described above by the adjustment mechanism being constructed differently with regard to the following points:

Instead of one adjusting rod 22, there are two adjusting rods 22A, 22B, each with a head 24A, 24B with a recess 25 for a socket screw key, but without the aforementioned thickening. In this embodiment, the head 24A, 24B of the two adjusting rods 22A, 22B is indeed thickened.

Two holes 19A, 19B with a screw thread are also made in the first carriage 8, and two passages 21A, 21B in the second carriage 20, whereby the heads 24A, 24B of the adjusting rods 22A, 22B do not fit through the passages 21A, 21B.

A first adjusting rod 22A is not inserted through a passage 21A in the second carriage 20, but is affixed such that the head 24A is at the location of a passage 21A such that it can be operated with a socket screw key via the passage 21A of the head 24A.

The second adjusting rod 22B is inserted through a passage 21B in the second carriage 20.

The adjustable securing of the lock plate 10 can be done in this embodiment by further turning the two adjusting rods 22A, 22B in or out of the holes 19A, 19B in the first carriage 8 by means of a socket screw key. Hereby the second carriage 20 acts as an end stop for the heads 24A, 24B of the adjusting rods 22A, 22B.

If the lock plate 10 has to be adjusted in a direction towards the side profile 12, the first adjusting rod 22A is first turned further in a hole 19A, to enable the first carriage 8 to be pulled in the direction of the second carriage 20, after which the second adjusting rod 22B is turned further into a hole 19B to effectively pull the first carriage 8 to the second carriage 20 and to secure the first carriage 8.

If the lock plate 10 has to be adjusted in a direction away from the side profile 12, the second adjusting rod 228 is turned further out of a hole 19B to enable the first carriage 8 to be pushed away from the second carriage 20, after which the first adjusting rod 22A is turned out of its hole 19A to effectively push the first carriage 8 away from the second carriage 20 and to secure the first carriage 8.

Although in the above example a motor 5 to drive the leaf 4 and a coupling 18 of a drive belt 7 with the leaf 4 are described, the invention is not limited to sliding windows 1 with a drive motor and leaves 4 for this purpose.

Although in the above examples the lock plate 10 is described as a separate component screwed to the first carriage 8, the lock plate 10 together with the first carriage 8 can also form one component, for example as a lock plate 10 with a base that is complementary to the shape of the groove 14.

The present invention is by no means limited to the embodiments described as an example and shown in the drawings, but a sliding window or sliding door according to the invention can be realised in all kinds of forms and dimensions and according to all kinds of variant methods, without departing from the scope of the invention.

The invention claimed is:

1. A leaf (4) of a sliding window (1) or sliding door, whereby the leaf (4) comprises a front and a back, a horizontal profile member (13) and an upright side profile member (12) perpendicular to the horizontal profile member (13) between the front and the back, whereby the horizontal profile member (13) is provided with a lock plate (10) for a lock (9), whereby the leaf (4) is equipped with an adjustment mechanism to be able to adjust a position of the lock plate (10) in a direction (P) in which the horizontal profile member (13) extends and to be able to secure the lock plate (10) to the leaf (4), whereby the adjustment mechanism can be operated from a side where the upright side profile member (12) is located, whereby the horizontal profile member (13) is provided with a first groove (14) with undercut flanks (15) that extends in a longitudinal direction of the horizontal profile member (13), whereby a first carriage (8) is held in the first groove (14), whereby the lock plate (10) forms part of the first carriage (8) or is fastened thereto, wherein the adjustment mechanism comprises the following components:

at least one hole (19) in the lock plate (10) or the first carriage attached thereto (8), whereby the at least one hole (19) extends horizontally and is provided with an internal screw thread, at least one adjusting rod (22) that is at least partly provided with an external screw thread and which is affixed in the hole (19), whereby the adjusting rod (22) has a head (24) that is arranged to engage with a tool to rotate the adjusting rod (22) and which is oriented towards a side where the side profile member (12) is located, wherein the adjustment mechanism also comprises a gripping element (20*a*), which, at least in a horizontal direction, has a fixed position with respect to the horizontal profile member (13), whereby the adjusting rod (22) and the gripping element (20*a*) are arranged such that the adjusting rod (22) can be secured to the gripping element (20*a*), or that the gripping element (20*a*) forms an end stop for the adjusting rod (22), wherein the side profile member (12) is provided with a second groove (14) with undercut flanks (15) that extends in a longitudinal direction of the side profile member (12), whereby a second carriage (20) is held in the second groove (14) and the gripping element (20*a*) is formed on the second carriage (20).

2. The leaf according to claim 1, wherein the horizontal profile member is a top profile member or bottom profile member of the leaf in a mounted position.

3. The leaf according to claim 1, wherein the at least one hole (19) is made in the first carriage (8).

4. The leaf according to claim 1, wherein the gripping element (20*a*) is disposed by the side profile member (12) that is fastened thereto.

5. The leaf according to claim 1, wherein the second carriage (20) at least partially protrudes out of the side profile member (12) in the longitudinal direction of the side profile member (12).

6. The leaf according to claim 1, wherein the horizontal profile member is a top profile member (13).

7. The sliding window or sliding door is provided with the leaf according to claim 1.

8. The sliding window or sliding door according to claim 1, wherein the horizontal profile member is at a top or a bottom of the leaf, and the side profile member extends vertically.

9. A leaf (4) of a sliding window (1) or sliding door, whereby the leaf (4) comprises a front and a back, a horizontal profile member (13) and an upright side profile member (12) perpendicular to the horizontal profile member (13) between the front and the back, whereby the horizontal profile member (13) is provided with a lock plate (10) for a lock (9), whereby the leaf (4) is equipped with an adjustment mechanism to be able to adjust a position of the lock plate (10) in a direction (P) in which the horizontal profile member (13) extends and to be able to secure the lock plate (10) to the leaf (4), whereby the adjustment mechanism can be operated from a side where the upright side profile member (12) is located, whereby the horizontal profile member (13) is provided with a first groove (14) with undercut flanks (15) that extends in a longitudinal direction of the horizontal profile member (13), whereby a first carriage (8) is held in the first groove (14), whereby the lock plate (10) forms part of the first carriage (8) or is fastened thereto, wherein the adjustment mechanism comprises the following components:

at least one hole (19) in the lock plate (10) or the first carriage attached thereto (8), whereby the at least one hole (19) extends horizontally and is provided with an internal screw thread, at least one adjusting rod (22) that is at least partly provided with an external screw thread and which is affixed in the hole (19), whereby the adjusting rod (22) has a head (24) that is arranged to engage with a tool to rotate the adjusting rod (22) and which is oriented towards a side where the side profile member (12) is located, wherein the adjustment mechanism also comprises a gripping element (20*a*), which, at least in a horizontal direction, has a fixed position with respect to the horizontal profile member (13), whereby the adjusting rod (22) and the gripping element (20*a*) are arranged such that the adjusting rod (22) can be secured to the gripping element (20*a*), or that the gripping element (20*a*) forms an end stop for the adjusting rod (22), wherein the gripping element (20*a*) is provided with a horizontal passage (21) and the adjusting rod (22) has a nut (26) and a screw thread is provided between the head (24) and the nut (26), whereby the passage (21) is of such a size that a part between the head (24) and the nut (26) fits through the passage (21), but not the nut (26).

10. The leaf according to claim 9, wherein the adjustment mechanism comprises two holes (19A, 19B) and two adjusting rods (22A, 22B), whereby the gripping element is provided with two horizontal passages.

11. The leaf according to claim 10, wherein the or adjusting rods (22A, 22B) each have a head (24, 24A, 24B) that is provided with a recess (25) for a socket screw key.

12. The leaf according to claim 9, wherein the horizontal profile member is a top profile member or bottom profile member of the leaf in a mounted position.

13. The leaf according to claim 9, wherein the at least one hole (19) is made in the first carriage (8).

14. The leaf according to claim 9, wherein the gripping element (20*a*) is disposed by the side profile member (12) that is fastened thereto.

15. The leaf according to claim 9, wherein the horizontal profile member is a top profile member (13).

16. The sliding window or sliding door is provided with the leaf according to claim 9.

17. The sliding window or sliding door according to claim 9, wherein the horizontal profile member is at a top or a bottom of the leaf, and the side profile member extends vertically.

* * * * *